United States Patent [19]

Shimada et al.

[11] 4,106,303

[45] Aug. 15, 1978

[54] MARINE OIL STORAGE INSTALLATION

[75] Inventors: Hiroyuki Shimada, Nagasaki; Shozo Toyoda, Yokohama, both of Japan

[73] Assignee: Mitsubishi Jukogyo Kabushiki Kaisha, Tokyo, Japan

[21] Appl. No.: 802,317

[22] Filed: Jun. 1, 1977

[30] Foreign Application Priority Data

Jun. 10, 1976 [JP] Japan ..... 51-68013

[51] Int. Cl.[2] ..... B63B 25/08; E02B 3/04

[52] U.S. Cl. ..... 61/101; 61/1 F; 61/5; 61/48; 61/86; 114/256; 114/257

[58] Field of Search ..... 61/86, 101, 104, 1 F, 61/5, 48; 114/256, 257; 141/387

[56] References Cited

U.S. PATENT DOCUMENTS

| | | | |
|---|---|---|---|
| 3,379,027 | 4/1968 | Mowell et al. | 61/104 |
| 3,407,768 | 10/1968 | Graham | 114/256 |
| 3,533,240 | 10/1970 | Lesh | 61/5 |
| 3,958,521 | 5/1976 | Memoli | 61/1 F X |

*Primary Examiner*—Jacob Shapiro

*Attorney, Agent, or Firm*—Toren, McGeady and Stanger

[57] ABSTRACT

A marine oil storage installation includes at least one floating type oil storage tank having a double bottom and double walls and is provided with shore connection means. Protector means composed of at least one line of floating members surrounds each oil storage tank for protecting each oil storage tank from damage as the result of waves and contacting moving objects and for preventing oil from flowing out. Mooring means for drawing each oil storage tank and, loading arm means carried on the mooring means adapted for connection and disconnection with the shore connection means on each tank are also provided. A shore based facility is installed on the shore or on an artificial land and communicates with the loading arm means, and a platform is installed in the sea for moorage of tankers and is provided with means communicating with the shore based facility for feeding oil between the tankers and the shore based facility.

4 Claims, 5 Drawing Figures

MARINE OIL STORAGE INSTALLATION

BACKGROUND OF THE INVENTION

The invention relates to a marine oil storage installation particularly adapted for the storage of petroleum. p Conventional oil storage installations have been constructed on the shore. Such oil storage installations present the posibility of disasters due to ground subsidence or earthquake shocks. Disasters particularly disasters due to ground subsidence have actually happened. Furthermore, such oil storage installations are normally fixed on the ground and cannot be transferred to another location, and therefore it is extremely difficult to protect them from fires which may spread from adjacent buildings. On the contrary, it is easy for a fire in the oil storage installation to spread to adjacent buildings.

Furthermore, it becomes more and more difficult to construct oil storage facilities, which require a large installation area, on the shore which permit ingress and egress of oil tankers.

The present invention has for its object to eliminate the above-mentioned difficulties by providing an oil storage installation comprising at least one floating type oil storage tank provided with shore connection means, each said storage tank having double walled side walls and a double walled bottom, protector means composed of at least one line of floating members surrounding each oil storage tank for protecting the oil storage tank from damage as the result of contacting moving objects and waves and for preventing oil from flowing out, mooring means for drawing each oil storage tank, loading arm means adapted for connection and disconnection with the shore connection means, a shore based facility installed on the shore or on an artificial land and communicating with said loading arm means, and a platform installed on the sea for moorage of tankers and provided with means communicating with said shore based facility for feeding oil between said tankers and said shore based facility.

The construction of the oil storage installation in accordance with the present invention has numerous advantages in comparison with the conventional oil storage installation constructed on the shore. First, since the oil storage installation of the present invention is constructed on the sea, ground subsidence and earthquake shocks have no effect on the oil storage installation and the possibility of the fire spreading from any building on the shore to the oil storage tank or from the oil storage tank to the building can be reduced. Further, if the fire spreading cannot be avoided, the oil storage tank may be transferred to a desired location after opening the oil fence and the floating member line. Second, the construction of the oil storage tank on the sea eliminates the need to secure the location for the oil storage installation. Third, since the wave arrester of the oil storage installation is of the floating type, it is easier in comparison with a wave arrester installed on the ocean floor to move the combination of the oil storage tank, the oil fence, and the wave arrester to a desired location merely by prolonging the oil tank mooring means and the connection means.

BRIEF DESCRIPTION OF THE DRAWINGS

One embodiment of a marine oil storage installation in accordance with the present invention will now be described, by way of example, with reference to the accompanying drawings in which.

DESCRIPTION OF THE INVENTION

Figure 1:
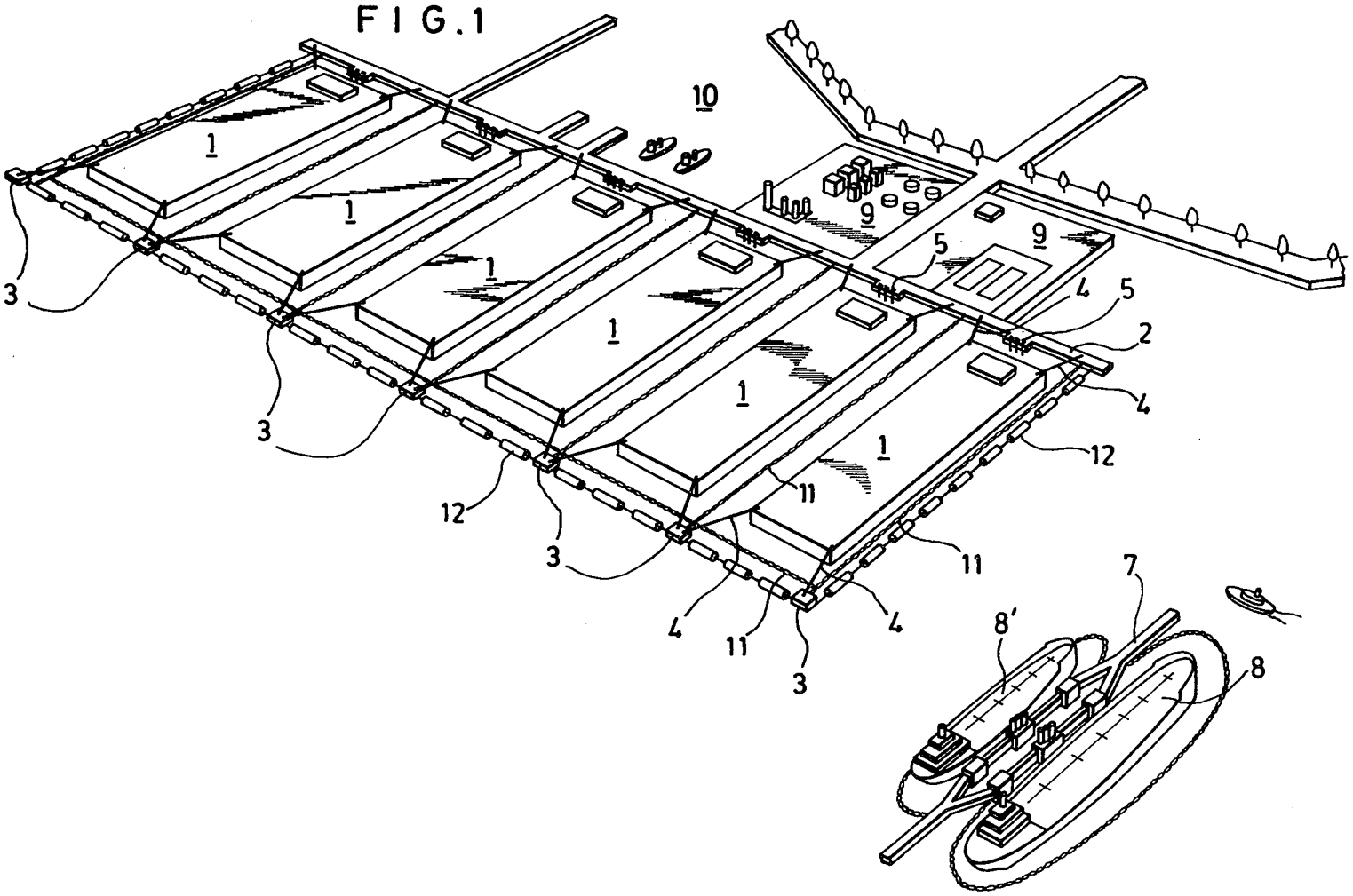
FIG. 1 is a perspective view illustrating one embodiment of an oil storage installation in accordance with the present invention.
Figure 2:
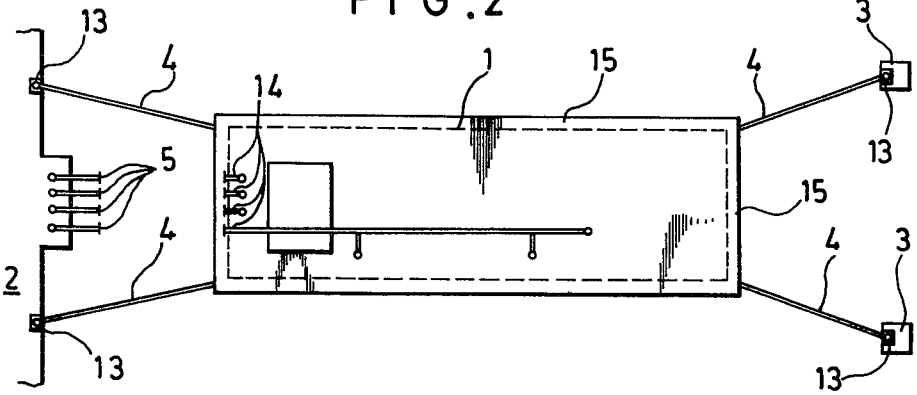
FIG. 2 is a plan view of a moored oil storage tank.
Figure 3:
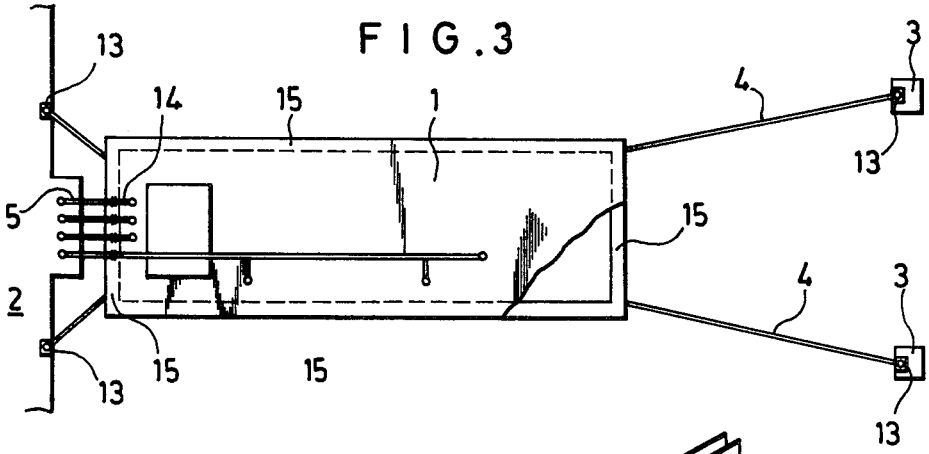
FIG. 3 is a plan view of the oil storage tank of FIG. 2 which is drawn toward the loading arm means.

In FIGS. 1 through 3, the reference numeral 1 designates the floating type oil storage tanks moored through mooring lines 4 to a mooring quay 2 and to mooring buoys 3 and surrounded twice by an oil fence 11 and a wave arrester 12. The mooring quay 2 functions as a walkway to which the oil storage tank 1 is moored through the mooring lines 4. The mooring buoys 3 are moored to the sea-bottom and floats on the sea on the side opposite to the mooring quay 2, and the oil storage tank 1 is moored through the mooring lines 4 to the mooring buoys 3. The mooring lines 4 are attached to the oil storage tank 1 for mooring it to the mooring quay 2 and to the mooring buoys 3.

The numeral 5 designates loading arm means adapted for connection to the shore connection means 14 of the oil storage tank 1 when the oil storage tank 1 is drawn toward the mooring quay 2 for charge or discharge of oil from the oil storage tank 1 and for disconnection from the oil storage tank 1 when the oil feeding operation is completed. The loading arm means 5 is connected through a pipe-line (not shown) to a shore based facility 9 and hence through a pipeline (not shown) to a platform 7.

The numeral 7 designates the platform installed on the sea remotely from the oil storage tank 1 for moorage of tankers 8 and 8' and providing means necessary for oil feeding operation which is communicated with the shore based facility 9. The shore based facility 9 has equipment for controlling the oil feeding operation.

The numeral 10 designates a camber in which towing ships or the like are moored, the numeral 11 the oil fence surrounding the oil storage tank 1 for holding the oil flowing out of the oil storage tank 1 or pouring during the oil feeding operation within the fence, the numeral 12 the wave arrester surrounding the oil fence 11 for protecting the oil storage tank 1 from damage as the result of contacting moving objects and waves.

The numeral 13 designates winches for drawing the oil storage tank 1 toward the mooring quay 2 when the charge or discharge of oil from the oil storage tank 1 is required to be accomplished and for returning it to the initial position when the oil charging or discharging operation is completed.

The numeral 14 designates the shore connection means provided on the oil storage tank 1 for connection to the loading arm means 5 during the oil charging or discharging operation.

The numeral 15 designates double walls provided as a safety measure to prevent oil from flowing out of the oil storage tank 1 when one of the walls are broken due to boat or moving substance damage (the oil storage tank 1 also has a double bottom which is not illustrated).

The operation of the oil storage installation of the present invention will now be described. When oil is charged from the tanker 8 into the oil storage tank 1, an oil fence is provided around the tanker 8 or 8' moored at the platform 7 to prevent oil from flowing out, and the tanker 8 waits for instructions from the shore based facility 9 to allow the start of the oil feeding operation. On the other hand, the mooring lines 4 of the oil storage tank 1 are released from the buoys 3 and the winches 13 are operated to draw the oil storage tank 1 toward the mooring quay 2 so as to connect the shore connection means 14 to the loading arm means 5.

When such a connection is made, the shore based facility 9 provides an instruction to allow the start of the oil feeding operation to the tanker 8. According to the instruction, oil is fed through the pipeline (not shown) to the loading arm means 5 and hence through the shore connection means 14 to the oil storage tank 1.

When the oil feeding operation is completed, the shore connection means 14 is disconnected from the loading arm means 5 and the winches 3 in the buoy side are operated to draw the oil storage tank 1 away from the mooring quay 2 to the initial position.

Where oil is fed from the oil storage tank 1 to the tanker 8, the operation is similar to the above operation except that the direction of the oil fed is reversed. For example, where oil is supplied to an overland transportation vehicle such as a tank truck, the supply is accomplished from the oil feeding means provided in the shore based facility 9.

When the oil storage tank 1 is required to be transferred to another location, for example, to avoid a fire, the mooring lines 4 are released from the mooring quay 2 and the mooring buoys 3 and then the oil fence between the mooring buoys 3 and the wave arrester 12 are opened to allow the oil storage tank 1 to be freely moved. The oil storage tank 1 can be transferred to a desired position by the use of a towing ship connected through lines to the oil storage tank 1. A number of oil storage tanks may be arranged in a comb fashion as illustrated in FIG. 1, which permits the oil storage tanks to be simultaneously moved according to the number of the towing ships.

The oil fence 11 serves to prevent the oil from flowing out if oil is flown out of the oil storage tank 1. The wave arrester 12 serves to divide the energy of waves to increase the safety of the oil storage tank 1 although the oil storage tank 1, which is moored at four points through the mooring lines 4 to the mooring quay 2 and the mooring buoys 3, is sufficiently safe. The wave arrester 12 has a further function of protecting the oil storage tank 1 from damage as the result of contacting moving objects and boats.

Figure 4:
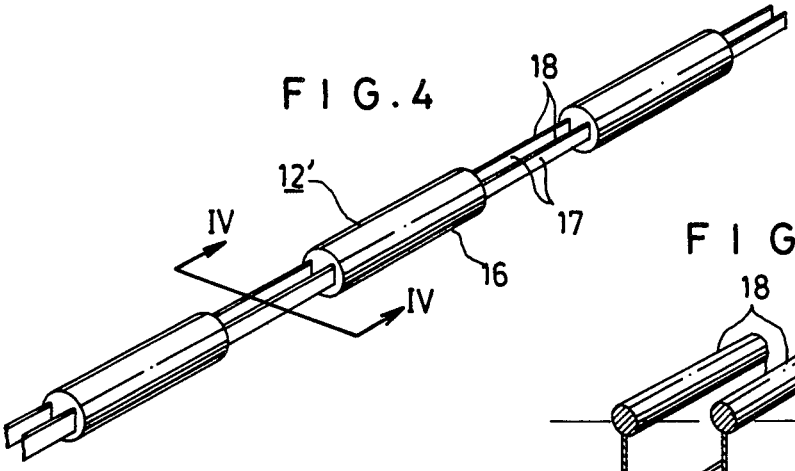
FIG. 4 shows an alternative embodiment of the present invention.
Figure 5:
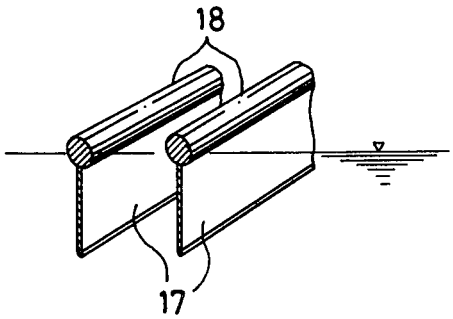
FIG. 5 is a perspective sectional illustration taken along the line IV—IV in FIG. 4.

FIGS. 4 and 5 show an alternative embodiment of the present invention in which the oil fence 11 and the wave arrester 12 are replaced by means 12' having functions of protecting the oil storage tank 1 from damage and of holding oil within the means. The means 12' comprises, in combination, wave arrester members 16 corresponding to the wave arrester 12 of the first described embodiment and curtains 17 hung from two lines 18. The curtains 17 are hung from the two lines 18 so as to cover the space between the wave arrester members 16 for holding oil therewithin. In the use of such means, the oil fence 11 may be used together therewith to increase the effect to prevent oil from flowing out.

Although the loading arm means 5 is provided on the mooring quay 2 in the first and second embodiments, it may be disposed to float adjacent the oil storage tank 1 to permit the oil storage tank 1 to be located further remotely from the shore. This can improve its safety. In addition, the shore based facility 9 may be installed on an artificial land remotely constructed from the store, in which case, the safety of the oil storage installation is also increased. Further, the number of the oil fences may be increased to improve the safety of the oil storage tank 1.

As described above, in accordance with the present invention, the oil storage installation is independent of ground subsidence and earthquake shocks and the possibility of a fire spreading from any building on the shore to the oil storage tank or from the oil storage tank to a building can be reduced since the oil storage installation is constructed on the sea. Further, the construction of the oil storage tank on the sea permits elimination of the need to secure the location for the oil storage installation. In addition, since the wave arrester is of a floating type, it is easy to transfer the combination of the oil storage tank, the oil fence, and the wave arrester to a desired location merely by prolonging the oil tank mooring means and the connection means.

What is claimed is:

1. A marine oil storage installation comprising at least one floating type oil storage tank provided with shore connection means to effect transfer of oil to and from said tank, each said storage tank having double walled side walls and a double walled bottom, protector means composed of at least one line of floating members surrounding each oil storage tank respectively for protecting each oil storage tank from damage as the result of waves and contacting moving objects and for preventing oil from flowing out of said installation, mooring means for drawing each oil storage tank, loading arm means carried on said mooring means being adapted for connection and disconnection with said shore connection means of each said oil storage tank respectively, a shore based facility installed on the shore or on an artificial land and communicating with said loading arm means on said mooring means, and a platform installed on the sea for moorage of tankers and provided with means communicating with said shore based facility for feeding oil between said tankers and said shore based facility.

2. A marine oil storage installation, as claimed in claim 1, wherein said protector means comprises an oil fence and a wave arrester.

3. A marine oil storage installation, as claimed in claim 1, wherein said protector means comprises a plurality of wave arrester members arranged at intervals in a line and oil-defense curtain members arranged in communication with said wave arrester members and therebetween.

4. A marine oil storage installation, as claimed in claim 1, wherein said mooring means comprises a mooring quay, mooring buoys confronting said mooring quay on the sea, winches attached to both said mooring quay and said mooring buoys respectively, and mooring lines for communication of said winches with each of said oil storage tanks.

* * * * *